US009812244B2

(12) United States Patent
Yazaki

(10) Patent No.: US 9,812,244 B2
(45) Date of Patent: Nov. 7, 2017

(54) MULTILAYER INDUCTOR DEVICE

(71) Applicant: Murata Manufacturing Co., Ltd., Kyoto (JP)

(72) Inventor: Hirokazu Yazaki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/810,789

(22) Filed: Jul. 28, 2015

(65) Prior Publication Data

US 2015/0332840 A1 Nov. 19, 2015

Related U.S. Application Data

(63) Continuation of application No. PCT/JP2013/083018, filed on Dec. 10, 2013.

(30) Foreign Application Priority Data

Mar. 4, 2013 (JP) ..... 2013-042262

(51) Int. Cl.

| | |
|---|---|
| ***H01F 5/00*** | (2006.01) |
| ***H01F 27/28*** | (2006.01) |
| ***H01F 27/29*** | (2006.01) |
| *H01F 38/02* | (2006.01) |

(52) U.S. Cl.

CPC ..... *H01F 27/2804* (2013.01); *H01F 27/2823* (2013.01); *H01F 27/29* (2013.01); *H01F 2027/2809* (2013.01); *H01F 2038/026* (2013.01)

(58) Field of Classification Search

CPC ..... H01F 2027/2809

USPC ..... 336/200, 223, 232

See application file for complete search history.

(56) References Cited

U.S. PATENT DOCUMENTS

| | | | | |
|---|---|---|---|---|
| 6,054,914 | A * | 4/2000 | Abel | H01F 1/344 336/200 |
| 6,891,736 | B2 | 5/2005 | Takemura | |
| 2006/0145804 | A1 | 7/2006 | Matsutani | |
| 2008/0272875 | A1 | 11/2008 | Huang | |

(Continued)

FOREIGN PATENT DOCUMENTS

| | | | |
|---|---|---|---|
| JP | 2003-284333 | A | 10/2003 |
| JP | 2003-532285 | A | 10/2003 |

(Continued)

OTHER PUBLICATIONS

International Search Report issued in Application No. PCT/JP2013/083018 dated Jan. 14, 2014.

(Continued)

*Primary Examiner* — Ronald Hinson
(74) *Attorney, Agent, or Firm* — Pearne & Gordon LLP

(57) ABSTRACT

A multilayer inductor device (10) includes a magnetic multilayer body (100) in which magnetic layers (110, 120, 130, 140) are laminated in this order. Coil conductors (211, 212) having winding forms are formed on the magnetic layers (110, 130), respectively. The coil conductors (211, 212) are coupled to each other with via conductors (311, 312, 313) to compose a first inductor (L1). Coil conductors (221, 222) having winding forms are formed on the magnetic layers (120, 140), respectively. The coil conductors (221, 222) are coupled to each other with via conductors (321, 322, 323) to compose a second inductor (L2).

2 Claims, 8 Drawing Sheets

(56) References Cited

U.S. PATENT DOCUMENTS

2010/0127812 A1* 5/2010 Maeda ..... H01F 17/0013
336/200

FOREIGN PATENT DOCUMENTS

JP 2009-503909 A 1/2009
WO 2004/055841 A1 7/2004

OTHER PUBLICATIONS

English translation of Written Opinion issued in Application No. PCT/JP2013/083018 dated Jan. 14, 2014.

* cited by examiner

MULTILAYER INDUCTOR DEVICE

BACKGROUND

Technical Field

The present disclosure relates to a multilayer inductor device in which multiple coils (inductors) are arranged so as to be coupled to each other with a high degree of coupling.

Background Art

Multiphase direct current-direct current (DC-DC) converters disclosed in, for example, Patent Document 1 are currently in widespread use for application of drive voltage of central processing units (CPUs). The multiphase DC-DC converters each use multiple choke coils. These multiple choke coils are required to have a high degree of coupling.

Accordingly, wire-wound choke coils are used as the multiple choke coils used in the multiphase DC-DC converter in the related art. The multiple choke coils are wound around a common magnetic core to increase the degree of coupling.

Patent Document 1: Japanese Unexamined Patent Application Publication No. 2003-284333

BRIEF SUMMARY

However, in the inductor devices having a structure in which the multiple wire-wound choke coils are wound around the common magnetic core, it is not easy to achieve low profile and decrease in size.

Some inductor devices in the related art have a structure in which multiple conductor patterns serving as individual inductors are independently formed in a ferrite multilayer substrate. However, in the multilayer inductor devices having such a structure in the related art, the respective multiple inductors are generally formed in separate areas when the multilayer inductor device is viewed in plan and the degree of coupling between the multiple inductors is low.

In order to resolve the above problems, the present disclosure provides a multilayer inductor device having a high degree of coupling between multiple inductors (choke coils).

The present disclosure provides a multilayer inductor device including a magnetic multilayer body in which multiple magnetic layers are laminated; and an inductor formed of coil conductors formed on certain layers in the multiple magnetic layers and a via conductor that passes through the coil conductors provided on different layers along a laminated direction. The laminated direction is a direction perpendicular to a largest surface of the magnetic layers. The multilayer inductor device includes multiple inductors. The coil conductors each have a winding form. Central axes of the winding forms along the laminated direction of the coil conductors of the multiple inductors substantially coincide with each other. The respective coil conductors composing the multiple inductors are periodically arranged along the laminated direction. The coil conductors composing each inductor are arranged so as to sandwich the coil conductors composing a different inductor therebetween.

With the above configuration, the coil conductors composing each inductor are magnetically coupled to each other in the laminated direction. Since the winding portions of the respective inductors are substantially overlapped with each other when the multilayer inductor device is viewed in plan, the degree of coupling between the inductors is high.

The multilayer inductor device of the present disclosure may include a common conductor that couples the multiple inductors to each other on one end layer along the laminated direction of the magnetic multilayer body.

With the above configuration, one end portions of the respective multiple inductor devices are coupled to each other. For example, when the inductor devices are mounted on a circuit board as choke coils for a multiphase DC-DC converter, the circuit pattern of the multiphase DC-DC converter is easily formed.

In the multilayer inductor device of the present disclosure, the multiple inductors may be coupled to each other so that, when current flows, the directions of magnetic fluxes occurring in the inductors the coil conductors of which are adjacent to each other in the laminated direction are opposite to each other.

With the above configuration, since the multiple inductors are coupled to each other so as to cancel the magnetic fluxes, saturation of the magnetic fluxes is difficult to occur. Accordingly, it is possible to increase saturation current as the choke coils.

The multilayer inductor device of the present disclosure may have the following configuration. Specifically, the multilayer inductor device may include an external connection terminal coupled to an end portion opposite to an end portion coupled to the common conductor in the multiple inductors and a common external connection terminal coupled to the common conductor. The external connection terminal and the common external connection terminal may be provided on a layer opposite to the one end layer along the laminated direction of the magnetic multilayer body. The common conductor and the common external connection terminal may be coupled to each other through via conductors formed at positions substantially coinciding with the central axes of the winding forms.

With the above configuration, it is possible to couple the multiple inductors to each other and to couple the multiple inductors to the common external connection terminal without necessarily increasing the size of the multilayer inductor device. In addition, since the via conductor, which couples the common conductor to the common external connection terminal, is wound at a position substantially coinciding with the central axes of the winding forms, deterioration in characteristics caused by the via conductor is difficult to occur.

According to the present disclosure, it is possible to realize a multilayer inductor device having a high degree of coupling between multiple inductors (choke coils).

DESCRIPTION OF EMBODIMENTS

Figure 1A:
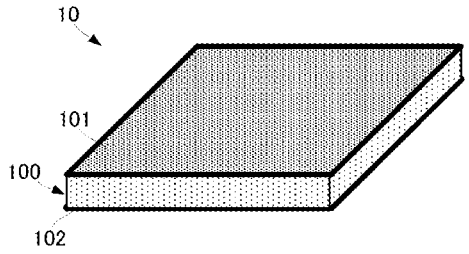
FIGS. 1A and 1B include an external perspective view of a multilayer inductor device and a conceptual side cross-sectional view illustrating the laminated structure of the multilayer inductor device according to the first embodiment of the present disclosure.
Figure 1B:
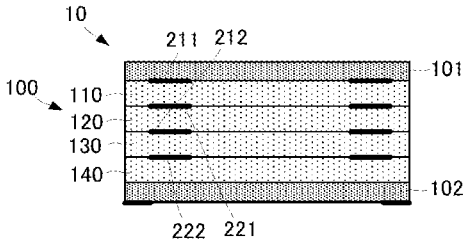
Figure 2:
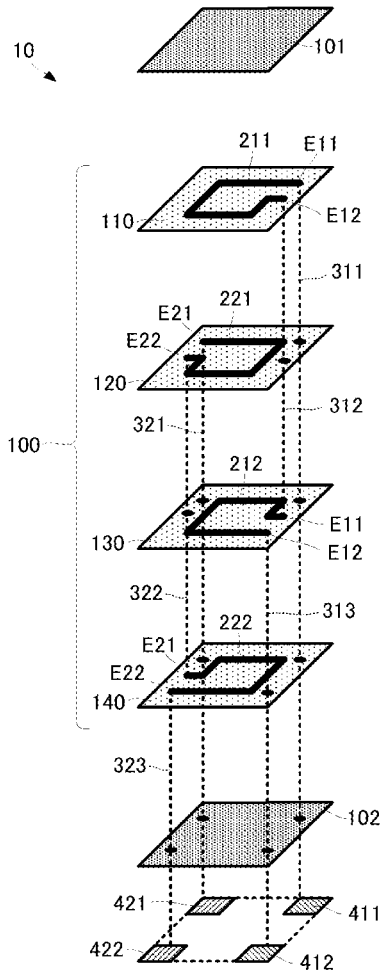
FIG. 2 is an exploded perspective view of the multilayer inductor device according to the first embodiment of the present disclosure.
Figure 3:
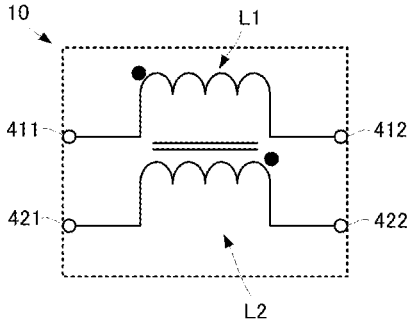
FIG. 3 is an equivalent circuit diagram of the multilayer inductor device according to the first embodiment of the present disclosure.

A multilayer inductor device according to a first embodiment of the present disclosure will now be described with reference to the attached drawings. FIG. 1A is an external perspective view of the multilayer inductor device according to the first embodiment of the present disclosure. FIG. 1B is a conceptual side cross-sectional view illustrating the laminated structure of the multilayer inductor device according to the first embodiment of the present disclosure. FIG. 2 is an exploded perspective view of the multilayer inductor device according to the first embodiment of the present disclosure. FIG. 3 is an equivalent circuit diagram of the multilayer inductor device according to the first embodiment of the present disclosure.

A multilayer inductor device 10 has a rectangular parallelepiped shape and includes a magnetic multilayer body 100 and non-magnetic layers 101 and 102. The magnetic multilayer body 100 includes magnetic layers 110, 120, 130, and 140. The magnetic layers 110, 120, 130, and 140 each have a certain thickness and each have a rectangular shape viewed in plan. The magnetic layers 110, 120, 130, and 140 are laminated so that their flat plane faces are parallel to each other. In the present embodiment, the magnetic layer 110, the magnetic layer 120, the magnetic layer 130, and the magnetic layer 140 are sequentially laminated from the upper layer side.

The non-magnetic layer 101 is arranged so as to abut against an upper-side end face of the magnetic multilayer body 100, that is, the magnetic layer 110. The non-magnetic layer 102 is arranged so as to abut against a lower-side end face of the magnetic layer 100, that is, the magnetic layer 140. In other words, the non-magnetic layers 101 and 102 are arranged so as to sandwich the magnetic multilayer body 100 therebetween in the laminated direction.

External connection terminals 411, 412, 421, and 422 are formed on the bottom face of the non-magnetic layer 102, that is, the bottom face of the multilayer inductor device 10. The external connection terminals 411, 412, 421, and 422 are rectangular conductors and are formed on the four corners of the non-magnetic layer 102.

A coil conductor 211 is formed on a front face (a face at the non-magnetic layer 101 side) of the magnetic layer 110. The coil conductor 211 is formed in a winding form when the magnetic layer 110 is viewed from plan. The coil conductor 211 does not have a loop shape and part of the coil conductor 211 is cut out.

A coil conductor 221 is formed on a front face (a face at the magnetic layer 110 side) of the magnetic layer 120. The coil conductor 221 is formed in a winding form when the magnetic layer 120 is viewed from plan. The coil conductor 221 does not have a loop shape and part of the coil conductor 221 is cut out.

A coil conductor 212 is formed on a front face (a face at the magnetic layer 120 side) of the magnetic layer 130. The coil conductor 212 is formed in a winding form when the magnetic layer 130 is viewed from plan. The coil conductor 212 does not have a loop shape and part of the coil conductor 212 is cut out.

A coil conductor 222 is formed on a front face (a face at the magnetic layer 130 side) of the magnetic layer 140. The coil conductor 222 is formed in a winding form when the magnetic layer 140 is viewed from plan. The coil conductor 222 does not have a loop shape and part of the coil conductor 222 is cut out.

Via conductors 311, 312, 313, 321, 322, and 323 are conductor patterns that pass through certain layers in the magnetic layers 110, 120, 130, and 140 and the non-magnetic layer 102 and that extend in the laminated direction.

The via conductor 311 couples the external connection terminal 411 to one end E11 of the coil conductor 211. The via conductor 312 couples the other end E12 of the coil conductor 211 to one end E11 of the coil conductor 212. The via conductor 313 couples the other end E12 of the coil conductor 212 to the external connection terminal 412.

Accordingly, the coil conductors 211 and 212 and the via conductors 311, 312, and 313 compose a first inductor L1 illustrated in FIG. 3. The first inductor L1 has a central axis passing through the center positions of the winding forms of the coil conductors 211 and 212 along the laminated direction of the magnetic multilayer body 100.

The via conductor 321 couples the external connection terminal 421 to one end E21 of the coil conductor 221. The via conductor 322 couples the other end E22 of the coil conductor 221 to one end E21 of the coil conductor 222. The via conductor 323 couples the other end E22 of the coil conductor 222 to the external connection terminal 422.

Accordingly, the coil conductors 221 and 222 and the via conductors 321, 322, and 323 compose a second inductor L2 illustrated in FIG. 3. The second inductor L2 has a central axis passing through the center positions of the winding forms of the coil conductors 221 and 222 along the laminated direction of the magnetic multilayer body 100.

In the above structure, the coil conductor 211 composing the first inductor L1 is adjacent to the coil conductor 221 composing the second inductor L2 in the laminated direction with the magnetic layer 110 sandwiched therebetween. The coil conductor 221 composing the second inductor L2 is adjacent to the coil conductor 212 composing the first inductor L1 in the laminated direction with the magnetic layer 120 sandwiched therebetween. The coil conductor 212 composing the first inductor L1 is adjacent to the coil conductor 222 composing the second inductor L2 in the laminated direction with the magnetic layer 130 sandwiched therebetween.

In other words, the coil conductors composing the first inductor L1 and the coil conductors composing the second inductor L2 are alternately and periodically arranged along the laminated direction.

With the above structure, the coil conductors composing the first inductor L1 are magnetically coupled to the coil conductors composing the second inductor L2 to achieve a high degree of coupling between the first inductor L1 and the second inductor L2.

In addition, since the winding form of the first inductor L1 is substantially overlapped with the winding form of the second inductor L2 when the magnetic multilayer body 100 is viewed in plan and the central axis of the first inductor L1 substantially coincides with that of the second inductor L2, it is possible to achieve a higher degree of coupling between the first inductor L1 and the second inductor L2.

In the above structure, when current is caused to flow from the external connection terminals 411 and 412 side, the direction of the magnetic flux occurring in the first inductor L1 is opposite to the direction of the magnetic flux occurring in the second inductor L2. As a result, since destructive interference occurs between the magnetic flux occurring in the first inductor L1 and the magnetic flux occurring in the second inductor L2, saturation of the magnetic flux caused by an increase in the current value is difficult to occur. In other words, it is possible to increase saturation current of the first inductor L1 and the second inductor L2. Accordingly, the above structure is effective when multiple choke coils are coupled to each other for use (when the choke coils are used for the multiphase DC-DC converter).

Figure 4:
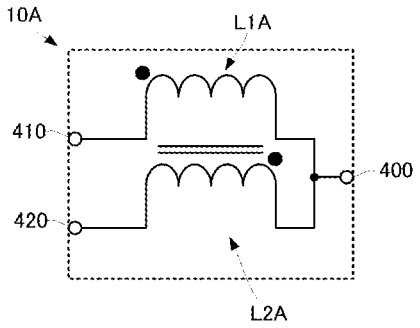
FIG. 4 is an equivalent circuit diagram of a multilayer inductor device according to a second embodiment of the present disclosure.
Figure 5:
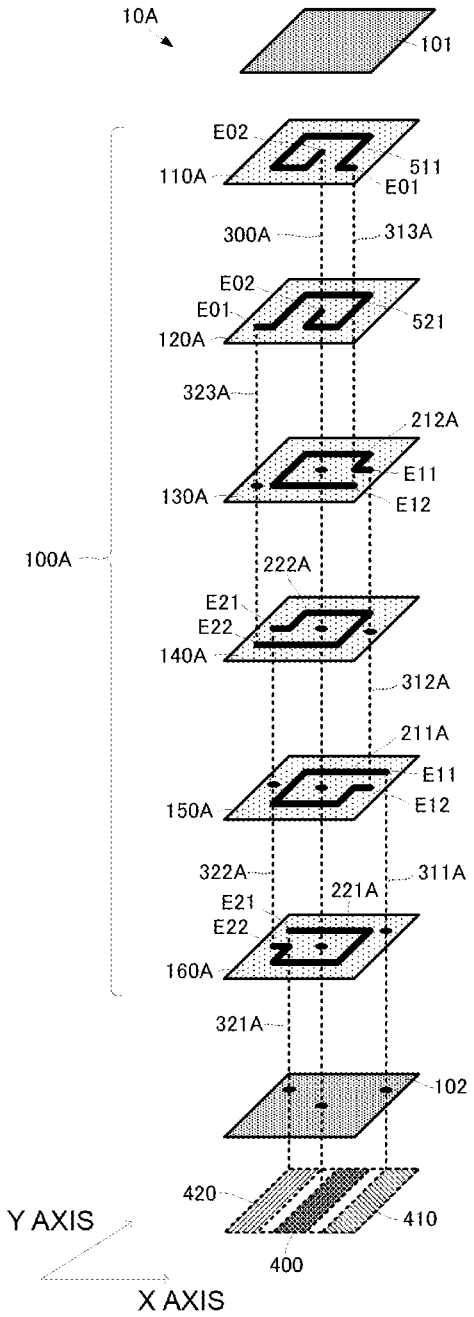
FIG. 5 is an exploded perspective view of the multilayer inductor device according to the second embodiment of the present disclosure.

A multilayer inductor device according to a second embodiment of the present disclosure will now be described with reference to the attached drawings. FIG. 4 is an equivalent circuit diagram of the multilayer inductor device according to the second embodiment of the present disclosure. FIG. 5 is an exploded perspective view of the multilayer inductor device according to the second embodiment of the present disclosure. From the viewpoint of the equivalent circuit, a multilayer inductor device 10A of the present embodiment differs from the multilayer inductor device 10 of the first embodiment in that one end portion of a first inductor L1A and one end portion of a second inductor L2A are coupled to a common external connection terminal 400. Accordingly, only portions different from the multilayer inductor device 10 according to the first embodiment are specifically described here.

As illustrated in FIG. 4, the first inductor L1A is coupled between an external connection terminal 410 and the common external connection terminal 400. The second inductor L2A is coupled between an external connection terminal 420 and the common external connection terminal 400.

The multilayer inductor device 10A has a rectangular parallelepiped shape and includes a magnetic multilayer body 100A and the non-magnetic layers 101 and 102. The magnetic multilayer body 100A includes magnetic layers 110A, 120A, 130A, 140A, 150A, and 160A.

The external connection terminals 410 and 420 and the common external connection terminal 400 are formed on the bottom face of the multilayer inductor device 10A, that is, the bottom face of the non-magnetic layer 102. The common external connection terminal 400 is arranged between the external connection terminals 410 and 420. More specifically, the external connection terminal 420, the common external connection terminal 400, and the external connection terminal 410 are sequentially arranged along a direction along a first side in the magnetic multilayer body 100A (an X direction illustrated in FIG. 5). The common external connection terminal 400 is arranged at a substantially center position of the X-axis direction.

A common conductor 511 is formed on a front face (a face at the non-magnetic layer 101 side) of the magnetic layer 110A. The common conductor 511 is formed in a winding form when the magnetic layer 110A is viewed from plan. The common conductor 511 does not have a loop shape and part of the common conductor 511 is cut out.

A common conductor 521 is formed on a front face (a face at the magnetic layer 110A side) of the magnetic layer 120A. The common conductor 521 is formed in a winding form when the magnetic layer 120A A is viewed from plan. The common conductor 521 does not have a loop shape and part of the common conductor 521 is cut out.

A coil conductor 212A is formed on a front face (a face at the magnetic layer 120A side) of the magnetic layer 130A. The coil conductor 212A is formed in a winding form when the magnetic layer 130A is viewed from plan. The coil conductor 212A does not have a loop shape and part of the coil conductor 212A is cut out.

A coil conductor 222A is formed on a front face (a face at the magnetic layer 130A side) of the magnetic layer 140A. The coil conductor 222A is formed in a winding form when the magnetic layer 140A is viewed from plan. The coil conductor 222A does not have a loop shape and part of the coil conductor 222A is cut out.

A coil conductor 211A is formed on a front face (a face at the magnetic layer 140A side) of the magnetic layer 150A. The coil conductor 211A is formed in a winding form when the magnetic layer 150A is viewed from plan. The coil conductor 211A does not have a loop shape and part of the coil conductor 211A is cut out.

A coil conductor 221A is formed on a front face (a face at the magnetic layer 150A side) of the magnetic layer 160A. The coil conductor 221A is formed in a winding form when the magnetic layer 160A is viewed from plan. The coil conductor 221A does not have a loop shape and part of the coil conductor 221A is cut out.

Via conductors 300A, 311A, 312A, 313A, 321A, 322A, and 323A are conductor patterns that pass through certain layers in the magnetic layers 110A, 120A, 130A, 140A, 150A, and 160A and the non-magnetic layer 102 and that extend in the laminated direction.

The via conductor 311A couples the external connection terminal 410 to one end E11 of the coil conductor 211A. The via conductor 312A couples the other end E12 of the coil conductor 211A to one end E11 of the coil conductor 212A. The via conductor 313A couples the other end E12 of the coil conductor 212A to one end E01 of the common conductor 511.

Accordingly, the coil conductors 211A and 212A and the via conductors 311A, 312A, and 313A compose the first inductor L1A illustrated in FIG. 4. The first inductor L1A has a central axis passing through the center positions of the winding forms of the coil conductors 211A and 212A along the laminated direction of the magnetic multilayer body 100A. When the magnetic multilayer body 100A is viewed in plan, the first inductor L1A has a shape that extends in a direction in which the angle is varied in the plus (+) direction from the external connection terminal 410, that is, that extends counterclockwise in an X-Y coordinate system using the center of the winding forms of the coil conductors 211A and 212A as the origin.

The via conductor 321A couples the external connection terminal 420 to one end E21 of the coil conductor 221A. The via conductor 322A couples the other end E22 of the coil conductor 221A to one end E21 of the coil conductor 222A. The via conductor 323A couples the other end E22 of the coil conductor 222A to one end E01 of the common conductor 521.

Accordingly, the coil conductors 221A and 222A and the via conductors 321A, 322A, and 323A compose the second inductor L2A illustrated in FIG. 4. The second inductor L2A has a central axis passing through the center positions of the winding forms of the coil conductors 221A and 222A along the laminated direction of the magnetic multilayer body 100A. When the magnetic multilayer body 100A is viewed in plan, the second inductor L2A has a shape that extends in a direction in which the angle is varied in the minus (−) direction from the external connection terminal 420, that is, that extends clockwise in an X-Y coordinate system using the center of the winding forms of the coil conductors 221A and 222A as the origin.

In addition, the via conductor 300A couples the other end E02 of the common conductor 511 and the other end E02 of the common conductor 521 to the common external connection terminal 400. Accordingly, the first inductor L1A and the second inductor L2A are coupled to the common external connection terminal 400.

In the above structure, the coil conductor 211A composing the first inductor L1A is adjacent to the coil conductor 221A composing the second inductor L2A in the laminated direction with the magnetic layer 150A sandwiched therebetween. The coil conductor 222A composing the second inductor L2A is adjacent to the coil conductor 211A composing the first inductor L1A in the laminated direction with the magnetic layer 140A sandwiched therebetween. The coil conductor 212A composing the first inductor L1A is adjacent to the coil conductor 222A composing the second inductor L2A in the laminated direction with the magnetic layer 130A sandwiched therebetween.

In other words, the coil conductors composing the first inductor L1A and the coil conductors composing the second inductor L2A are alternately and periodically arranged along the laminated direction.

With the above structure, the coil conductors composing the first inductor L1A are magnetically coupled to the coil conductors composing the second inductor L2A to achieve a high degree of coupling between the first inductor L1A and the second inductor L2A.

In addition, since the winding form of the first inductor L1A is substantially overlapped with the winding form of the second inductor L2A when the magnetic multilayer body 100A is viewed in plan and the central axis of the first inductor L1A substantially coincides with that of the second inductor L2A, it is possible to achieve a higher degree of coupling between the first inductor L1A and the second inductor L2A.

Furthermore, in the above structure, when the magnetic multilayer body 100A is viewed in plan, the winding direction of the first inductor L1A from the external connection terminal 410 to the common external connection terminal 400 is opposite to the winding direction of the second inductor L2A from the external connection terminal 420 to the common external connection terminal 400.

Accordingly, when current is caused to flow from the external connection terminals 410 and 420 in the same direction or current is caused to flow from the common external connection terminal 400, the direction of the magnetic flux occurring in the first inductor L1A is opposite to the direction of the magnetic flux occurring in the second inductor L2A. As a result, since destructive interference occurs between the magnetic flux occurring in the first inductor L1A and the magnetic flux occurring in the second inductor L2A, saturation of the magnetic flux caused by an increase in the current value is difficult to occur. In other words, it is possible to increase saturation current of the first inductor L1A and the second inductor L2A. Accordingly, the above structure is effective when multiple choke coils are coupled to each other for use (when the choke coils are used for the multiphase DC-DC converter).

Furthermore, since the first inductor L1A is coupled to the second inductor L2A in the structure of the present embodiment, it is not necessary to couple the first inductor L1A to the second inductor L2A with an external circuit.

Furthermore, since the via conductor 300A coupled to the common external connection terminal 400 exists at a position substantially coinciding with the central axis of the winding forms of the first and second inductors L1A and L2A in the structure of the present embodiment, it is possible to suppress interference between the magnetic fluxes caused by the first and second inductors L1A and L2A and the via conductor 300A.

Furthermore, since the common conductors 511 and 521 each have a winding form in the structure of the present embodiment, the common conductors 511 and 521 are capable of being used as part of the first and second inductors L1A and L2A, respectively. This allows the inductances of the first and second inductors L1A and L2A to be further increased.

Figure 6:
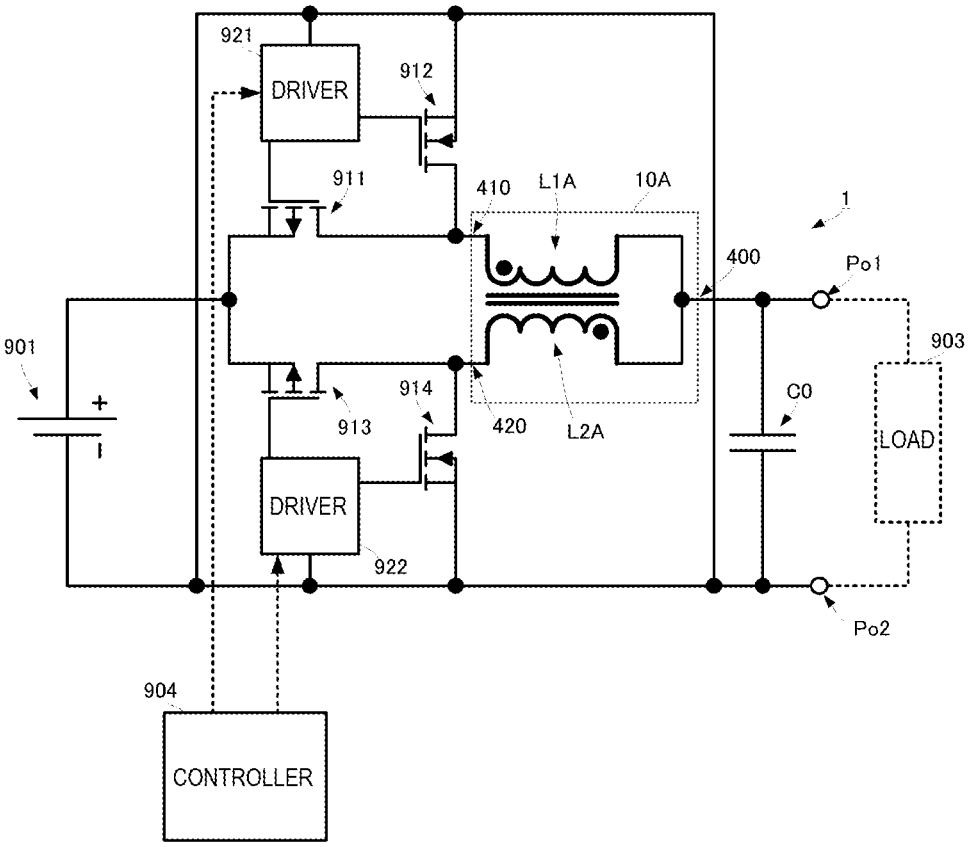
FIG. 6 is an equivalent circuit diagram of a DC-DC converter according to an embodiment of the present disclosure.

The multilayer inductor device 10A having the above structure is capable of being used in a DC-DC converter illustrated in FIG. 6. FIG. 6 is an equivalent circuit diagram of a DC-DC converter according to an embodiment of the present disclosure. A DC-DC converter 1 of the present embodiment is a so-called multiphase DC-DC converter. A detailed description of the circuit configuration and the operation of the DC-DC converter 1 is omitted herein.

The DC-DC converter 1 includes a direct current (DC) power supply 901, switch elements 911, 912, 913, and 914, driver circuits 921 and 922, a controller 904, the multilayer inductor device 10A, and an output capacitor C0.

A cascode circuit of the switch elements 911 and 912 and a cascode circuit of the switch elements 913 and 914 are connected in parallel between a + terminal and a − terminal of the DC power supply 901. The − terminal of the DC power supply 901 is connected to a low-voltage-side output terminal Po2.

The switch elements 911 and 912 are connected to the driver circuit 921. Gates of the switch elements 913 and 914 are connected to the driver circuit 922.

A node between the switch element 911 and the switch element 912 is connected to the external connection terminal 410 of the first inductor L1A in the multilayer inductor device 10A. A node between the switch element 913 and the switch element 914 is connected to the external connection terminal 420 of the second inductor L2A in the multilayer inductor device 10A.

The common external connection terminal 400 of the multilayer inductor device 10A is connected to a high-voltage-side output terminal Po1.

The output capacitor C0 is connected between the high-voltage-side output terminal Po1 and the low-voltage-side output terminal Po2. A load 903, such as a central processing unit (CPU), is connected to the high-voltage-side output terminal Po1 and the low-voltage-side output terminal Po2.

In such a multiphase DC-DC converter, the first inductor L1A may be coupled to the second inductor L2A with a high degree of coupling. The use of the multilayer inductor device 10A of the present embodiment allows the high degree of coupling to be realized. Accordingly, it is possible to realize the multiphase DC-DC converter having excellent output characteristics.

Figure 7:
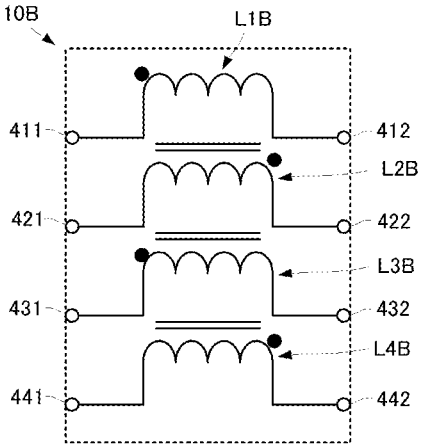
FIG. 7 is an equivalent circuit diagram of a multilayer inductor device according to a third embodiment of the present disclosure.
Figure 8:
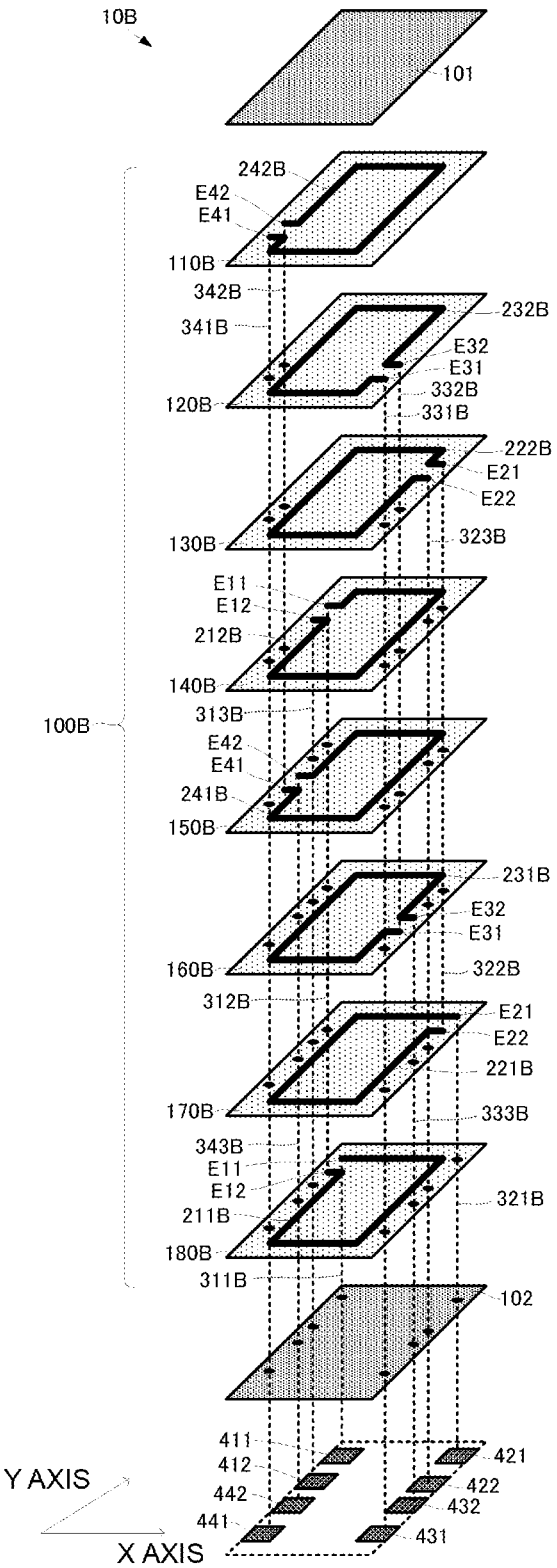
FIG. 8 is an exploded perspective view of the multilayer inductor device according to the third embodiment of the present disclosure.

A multilayer inductor device according to a third embodiment will now be described with reference to the attached drawings. FIG. 7 is an equivalent circuit diagram of the multilayer inductor device according to the third embodiment of the present disclosure. FIG. 8 is an exploded perspective view of the multilayer inductor device according to the third embodiment of the present disclosure. From the viewpoint of the equivalent circuit, a multilayer inductor device 10B of the present embodiment differs from the multilayer inductor device 10 of the first embodiment in the number of inductors included in the multilayer inductor device 10B. Accordingly, only portions different from the multilayer inductor device 10 according to the first embodiment are specifically described here.

From the viewpoint of the circuit, the multilayer inductor device 10B includes first, second, third, and fourth inductors L1B, L2B, L3B, and L4B. The first inductor L1B is coupled between external connection terminals 411 and 412. The second inductor L2B is coupled between external connection terminals 421 and 422. The third inductor L3B is coupled between external connection terminals 431 and 432. The fourth inductor L4B is coupled between external connection terminals 441 and 442.

The multilayer inductor device 10B has a rectangular parallelepiped shape and includes a magnetic multilayer body 100B and the non-magnetic layers 101 and 102. The magnetic multilayer body 100B includes magnetic layers 110B, 120B, 130B, 140B, 150B, 160B, 170B, and 180B.

The external connection terminals 411, 412, 421, 422, 431, 432, 441, and 442 are formed on the bottom face of the multilayer inductor device 10B, that is, the bottom face of the non-magnetic layer 102. The external connection terminals 411, 412, 441, and 442 are arranged on one side in the X-axis direction along the Y-axis direction. The external connection terminals 421, 422, 431, and 432 are arranged on the other side in the X-axis direction along the Y-axis direction.

A coil conductor 242B is formed on a front face (a face at the non-magnetic layer 101 side) of the magnetic layer 110B. The coil conductor 242B is formed in a winding form when the magnetic layer 110B is viewed from plan. The coil conductor 242B does not have a loop shape and part of the coil conductor 242B is cut out.

A coil conductor 232B is formed on a front face (a face at the magnetic layer 110B side) of the magnetic layer 120B. The coil conductor 232B is formed in a winding form when the magnetic layer 120B is viewed from plan. The coil conductor 232B does not have a loop shape and part of the coil conductor 232B is cut out.

A coil conductor 222B is formed on a front face (a face at the magnetic layer 120B side) of the magnetic layer 130B. The coil conductor 222B is formed in a winding form when the magnetic layer 130B is viewed from plan. The coil conductor 222B does not have a loop shape and part of the coil conductor 222B is cut out.

A coil conductor 212B is formed on a front face (a face at the magnetic layer 130B side) of the magnetic layer 140B. The coil conductor 212B is formed in a winding form when the magnetic layer 140B is viewed from plan. The coil conductor 212B does not have a loop shape and part of the coil conductor 212B is cut out.

A coil conductor 241B is formed on a front face (a face at the magnetic layer 140B side) of the magnetic layer 150B. The coil conductor 241B is formed in a winding form when the magnetic layer 150B is viewed from plan. The coil conductor 241B does not have a loop shape and part of the coil conductor 241B is cut out.

A coil conductor 231B is formed on a front face (a face at the magnetic layer 150B side) of the magnetic layer 160B. The coil conductor 231B is formed in a winding form when the magnetic layer 160B is viewed from plan. The coil conductor 231B does not have a loop shape and part of the coil conductor 231B is cut out.

A coil conductor 221B is formed on a front face (a face at the magnetic layer 160B side) of the magnetic layer 170B. The coil conductor 221B is formed in a winding form when the magnetic layer 170B is viewed from plan. The coil conductor 221B does not have a loop shape and part of the coil conductor 221B is cut out.

A coil conductor 211B is formed on a front face (a face at the magnetic layer 170B side) of the magnetic layer 180B. The coil conductor 211B is formed in a winding form when the magnetic layer 180B is viewed from plan. The coil conductor 211B does not have a loop shape and part of the coil conductor 211B is cut out.

Via conductors 311B, 312B, 313B, 321B, 322B, 323B, 331B, 332B, 333B, 341B, 342B, and 343B are conductor patterns that pass through certain layers in the magnetic layer 110B to magnetic layer 180B and the non-magnetic layer 102 and that extend in the laminated direction.

The via conductor 311B couples the external connection terminal 411 to one end E11 of the coil conductor 211B. The via conductor 312B couples the other end E12 of the coil conductor 211B to one end E11 of the coil conductor 212B. The via conductor 313B couples the other end E12 of the coil conductor 212B to the external connection terminal 412.

Accordingly, the coil conductors 211B and 212B and the via conductors 311B, 312B, and 313B compose the first inductor L1B illustrated in FIG. 7. The first inductor L1B has a central axis passing through the center positions of the winding forms of the coil conductors 211B and 212B along the laminated direction of the magnetic multilayer body 100B.

The via conductor 321B couples the external connection terminal 421 to one end E21 of the coil conductor 221B. The via conductor 322B couples the other end E22 of the coil conductor 221B to one end E21 of the coil conductor 222B. The via conductor 323B couples the other end E22 of the coil conductor 222B to external connection terminal 422.

Accordingly, the coil conductors 221B and 222B and the via conductors 321B, 322B, and 323B compose the second inductor L2B illustrated in FIG. 7. The second inductor L2B has a central axis passing through the center positions of the winding forms of the coil conductors 221B and 222B along the laminated direction of the magnetic multilayer body 100B.

The via conductor 331B couples the external connection terminal 431 to one end E31 of the coil conductor 232B. The via conductor 332B couples the other end E32 of the coil conductor 232B to one end E31 of the coil conductor 231B. The via conductor 333B couples the other end E32 of the coil conductor 231B to the external connection terminal 432.

Accordingly, the coil conductors 231B and 232B and the via conductors 331B, 332B, and 333B compose the third inductor L3B illustrated in FIG. 7. The third inductor L3B has a central axis passing through the center positions of the winding forms of the coil conductors 231B and 232B along the laminated direction of the magnetic multilayer body 100B.

The via conductor 341B couples the external connection terminal 441 to one end E41 of the coil conductor 242B. The via conductor 342B couples the other end E42 of the coil conductor 242B to one end E41 of the coil conductor 241B. The via conductor 343B couples the other end E42 of the coil conductor 241B to the external connection terminal 442.

Accordingly, the coil conductors 241B and 242B and the via conductors 341B, 342B, and 343B compose the fourth inductor L4B illustrated in FIG. 7. The fourth inductor L4B has a central axis passing through the center positions of the winding forms of the coil conductors 241B and 242B along the laminated direction of the magnetic multilayer body 100B.

In the above structure, the coil conductor 211B composing the first inductor L1B is adjacent to the coil conductor 221B composing the second inductor L2B in the laminated direction with the magnetic layer 170B sandwiched therebetween. The coil conductor 221B composing the second inductor L2B is adjacent to the coil conductor 231B composing the third inductor L3B in the laminated direction with the magnetic layer 160B sandwiched therebetween. The coil conductor 231B composing the third inductor L3B is adjacent to the coil conductor 241B composing the fourth inductor L4B in the laminated direction with the magnetic layer 150B sandwiched therebetween. The coil conductor 241B composing the fourth inductor L4B is adjacent to the coil conductor 212B composing the first inductor L1B in the laminated direction with the magnetic layer 140B sandwiched therebetween.

The coil conductor 212B composing the first inductor L1B is adjacent to the coil conductor 222B composing the second inductor L2B in the laminated direction with the magnetic layer 130B sandwiched therebetween. The coil conductor 222B composing the second inductor L2B is adjacent to the coil conductor 232B composing the third inductor L3B in the laminated direction with the magnetic layer 120B sandwiched therebetween. The coil conductor 232B composing the third inductor L3B is adjacent to the coil conductor 242B composing the fourth inductor L4B in the laminated direction with the magnetic layer 110B sandwiched therebetween.

In other words, the coil conductors composing the first inductor L1B, the coil conductors composing the second inductor L2B, the coil conductors composing the third inductor L3B, and the coil conductors composing the fourth inductor L4B are periodically arranged along the laminated direction.

With the above structure, the coil conductors composing the first inductor L1B are magnetically coupled to the coil conductors composing the second inductor L2B, the coil conductors composing the second inductor L2B are magnetically coupled to the coil conductors composing the third inductor L3B, the coil conductors composing the third inductor L3B are magnetically coupled to the coil conductors composing the fourth inductor L4B, and the coil conductors composing the fourth inductor L4B are magnetically coupled to the coil conductors composing the first inductor L1B. Accordingly, it is possible to achieve a high degree of coupling between the inductors that are adjacent to each other in the laminated direction.

In addition, since the winding forms of the first, second, third, and fourth inductors L1B, L2B, L3B, and L4B are substantially overlapped with each other when the magnetic multilayer body 100B is viewed in plan and the central axes of the first, second, third, and fourth inductors L1B, L2B, L3B, and L4B substantially coincide with each other, it is possible to achieve a higher degree of coupling between the first, second, third, and fourth inductors L1B, L2B, L3B, and L4B.

In the above structure, when current is caused to flow from the external connection terminals 411, 421, 431, and 441 sides, the direction of the magnetic flux occurring in the first inductor L1B is opposite to the direction of the magnetic flux occurring in the second inductor L2B. The direction of the magnetic flux occurring in the second inductor L2B is opposite to the direction of the magnetic flux occurring in the third inductor L3B. The direction of the magnetic flux occurring in the third inductor L3B is opposite to the direction of the magnetic flux occurring in the fourth inductor L4B. The direction of the magnetic flux occurring in the fourth inductor L4B is opposite to the direction of the magnetic flux occurring in the first inductor L1B.

As a result, since destructive interference occurs between the magnetic fluxes occurring between the inductors that are adjacent to each other in the laminated direction, saturation of the magnetic flux caused by an increase in the current value is difficult to occur. In other words, it is possible to increase saturation current of the first, second, third, and fourth inductors L1B, L2B, L3B, and L4B. Accordingly, the above structure is effective when multiple choke coils are coupled to each other for use (when the choke coils are used for the multiphase DC-DC converter).

Figure 9:
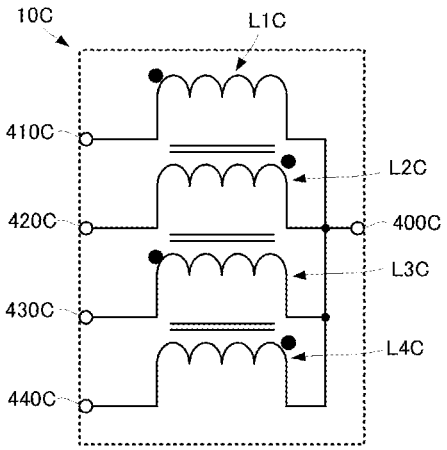
FIG. 9 is an equivalent circuit diagram of a multilayer inductor device according to a fourth embodiment of the present disclosure.
Figure 10:
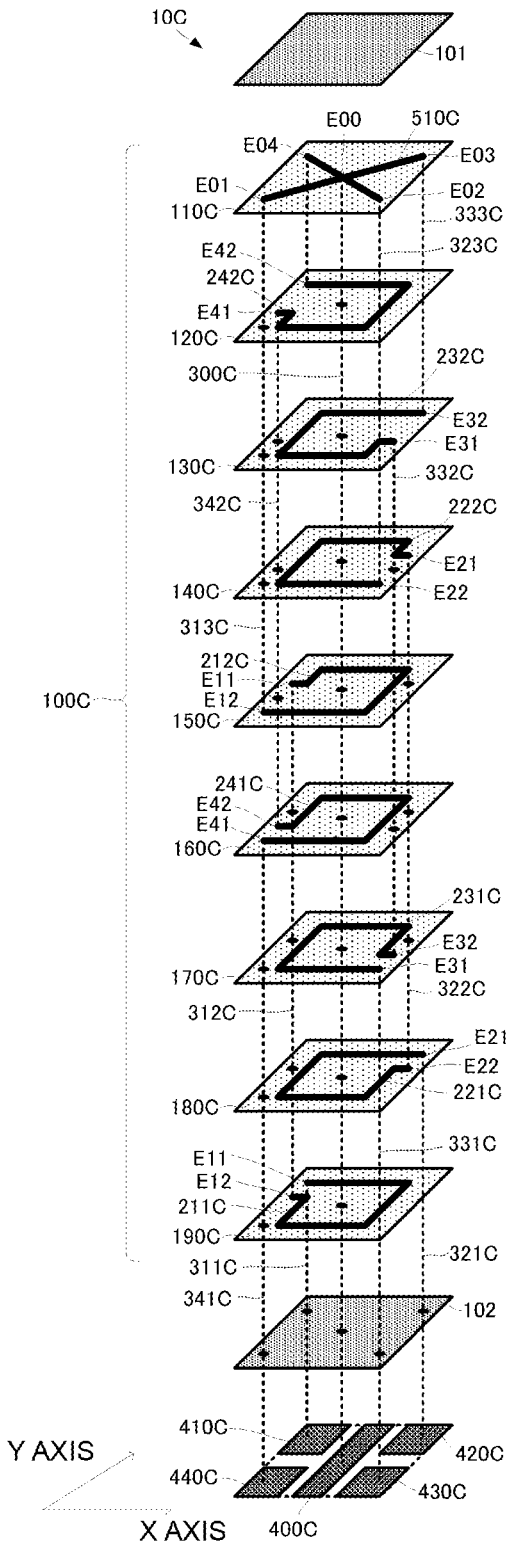
FIG. 10 is an exploded perspective view of the multilayer inductor device according to the fourth embodiment of the present disclosure.

A multilayer inductor device according to a fourth embodiment of the present disclosure will now be described with reference to the attached drawings. FIG. 9 is an equivalent circuit diagram of the multilayer inductor device according to the fourth embodiment of the present disclosure. FIG. 10 is an exploded perspective view of the multilayer inductor device according to the fourth embodiment of the present disclosure. From the viewpoint of the equivalent circuit, a multilayer inductor device 10C of the present embodiment differs from the multilayer inductor device 10B of the third embodiment in that one end portion of each of first, second, third, and fourth inductors L1C, L2C, L3C, and L4C is coupled to a common external connection terminal 400C. Accordingly, only portions different from the multilayer inductor device 10B according to the third embodiment are specifically described here.

As illustrated in FIG. 9, the first inductor L1C is coupled between an external connection terminal 410C and the common external connection terminal 400C. The second inductor L2C is coupled between an external connection terminal 420C and the common external connection terminal 400C. The third inductor L3C is coupled between an external connection terminal 430C and the common external connection terminal 400C. The fourth inductor L4C is coupled between an external connection terminal 440C and the common external connection terminal 400C.

The multilayer inductor device 10C has a rectangular parallelepiped shape and includes a magnetic multilayer body 100C and the non-magnetic layers 101 and 102. The magnetic multilayer body 100C includes magnetic layers 110C, 120C, 130C, 140C, 150C, 160C, 170C, 180C, and 190C.

The external connection terminals 410C, 420C, 430C, and 440C and the common external connection terminal 400C are formed on the bottom face of the magnetic multilayer body 100C, that is, the bottom face of the non-magnetic layer 102. The external connection terminals 410C, 420C, 430C, and 440C are formed at four corners of the bottom face of the magnetic multilayer body 100C. The common external connection terminal 400C is arranged between the external connection terminals 410C and 440C and the external connection terminals 420C and 430C. More specifically, the external connection terminals 410C and 440C, the common external connection terminal 400C, and the external connection terminals 420C and 430C are sequentially arranged along a direction along a first side in the magnetic multilayer body 100C (an X direction illustrated in FIG. 10). The common external connection terminal 400C is arranged at a substantially center position of the X-axis direction.

A common conductor 510C is formed on a front face of the magnetic layer 110C (a face at the non-magnetic layer 101 side). The common conductor 510C has a shape in which two straight conductors intersect with each other at a certain angle.

A coil conductor 242C is formed on a front face (a face at the magnetic layer 110C side) of the magnetic layer 120C. The coil conductor 242C is formed in a winding form when the magnetic layer 120C is viewed from plan. The coil conductor 242C does not have a loop shape and part of the coil conductor 242C is cut out.

A coil conductor 232C is formed on a front face (a face at the magnetic layer 120C side) of the magnetic layer 130C. The coil conductor 232C is formed in a winding form when the magnetic layer 130C is viewed from plan. The coil conductor 232C does not have a loop shape and part of the coil conductor 232C is cut out.

A coil conductor 222C is formed on a front face (a face at the magnetic layer 130C side) of the magnetic layer 140C. The coil conductor 222C is formed in a winding form when the magnetic layer 140C is viewed from plan. The coil conductor 222C does not have a loop shape and part of the coil conductor 222C is cut out.

A coil conductor 212C is formed on a front face (a face at the magnetic layer 140C side) of the magnetic layer 150C. The coil conductor 212C is formed in a winding form when the magnetic layer 150C is viewed from plan. The coil conductor 212C does not have a loop shape and part of the coil conductor 212C is cut out.

A coil conductor 241C is formed on a front face (a face at the magnetic layer 150C side) of the magnetic layer 160C. The coil conductor 241C is formed in a winding form when the magnetic layer 160C is viewed from plan. The coil conductor 241C does not have a loop shape and part of the coil conductor 241C is cut out.

A coil conductor 231C is formed on a front face (a face at the magnetic layer 160C side) of the magnetic layer 170C. The coil conductor 231C is formed in a winding form when the magnetic layer 170C is viewed from plan. The coil conductor 231C does not have a loop shape and part of the coil conductor 231C is cut out.

A coil conductor 221C is formed on a front face (a face at the magnetic layer 170C side) of the magnetic layer 180C. The coil conductor 221C is formed in a winding form when the magnetic layer 180C is viewed from plan. The coil conductor 221C does not have a loop shape and part of the coil conductor 221C is cut out.

A coil conductor 211C is formed on a front face (a face at the magnetic layer 180C side) of the magnetic layer 190C. The coil conductor 211C is formed in a winding form when the magnetic layer 190C is viewed from plan. The coil conductor 211C does not have a loop shape and part of the coil conductor 211C is cut out.

Via conductors 300C, 311C, 312C, 313C, 321C, 322C, 323C, 331C, 332C, 333C, 341C, 342C, and 343C are conductor patterns that pass through certain layers in the magnetic layers 110C, 120C, 130C, 140C, 150C, 160C, 170C, 180C, and 190C and the non-magnetic layer 102 and that extend in the laminated direction.

The via conductor 311C couples the external connection terminal 410C to one end E11 of the coil conductor 211C. The via conductor 312C couples the other end E12 of the coil conductor 211C to one end E11 of the coil conductor 212C. The via conductor 313C couples the other end E12 of the coil conductor 212C to an end E01 of the common conductor 510C.

Accordingly, the coil conductors 211C and 212C and the via conductors 311C, 312C, and 313C compose the first inductor L1C illustrated in FIG. 9. The first inductor L1C has a central axis passing through the center positions of the winding forms of the coil conductors 211C and 212C along the laminated direction of the magnetic multilayer body 100C. When the magnetic multilayer body 100C is viewed in plan, the first inductor L1C has a shape that extends in a direction in which the angle is varied in the minus (−) direction from the external connection terminal 410C, that is, that extends clockwise in an X-Y coordinate system using the center of the winding forms of the coil conductors 211C and 212C as the origin.

The via conductor 321C couples the external connection terminal 420C to one end E21 of the coil conductor 221C. The via conductor 322C couples the other end E22 of the coil conductor 221C to one end E21 of the coil conductor 222C. The via conductor 323C couples the other end E22 of the coil conductor 222C to an end E02 of the common conductor 510C.

Accordingly, the coil conductors 221C and 222C and the via conductors 321C, 322C, and 323C compose the second inductor L2C illustrated in FIG. 9. The second inductor L2C has a central axis passing through the center positions of the winding forms of the coil conductors 221C and 222C along the laminated direction of the magnetic multilayer body 100C. When the magnetic multilayer body 100C is viewed in plan, the second inductor L2C has a shape that extends in a direction in which the angle is varied in the plus (+) direction from the external connection terminal 420C, that is, that extends counterclockwise in an X-Y coordinate system using the center of the winding forms of the coil conductors 221C and 222C as the origin.

The via conductor 331C couples the external connection terminal 430C to one end E31 of the coil conductor 231C. The via conductor 332C couples the other end E32 of the coil conductor 231C to one end E31 of the coil conductor 232C. The via conductor 333C couples the other end E32 of the coil conductor 232C to an end E03 of the common conductor 510C.

Accordingly, the coil conductors 231C and 232C and the via conductors 331C, 332C, and 333C compose the third inductor L3C illustrated in FIG. 9. The third inductor L3C has a central axis passing through the center positions of the winding forms of the coil conductors 231C and 232C along the laminated direction of the magnetic multilayer body 100C. When the magnetic multilayer body 100C is viewed in plan, the third inductor L3C has a shape that extends in a direction in which the angle is varied in the minus (−) direction from the external connection terminal 430C, that is, that extends clockwise in an X-Y coordinate system using the center of the winding forms of the coil conductors 231C and 232C as the origin.

The via conductor 341C couples the external connection terminal 440C to one end E41 of the coil conductor 241C. The via conductor 342C couples the other end E42 of the coil conductor 241C to one end E41 of the coil conductor 242C. The via conductor 343C couples the other end E42 of the coil conductor 242C to an end E04 of the common conductor 510C.

Accordingly, the coil conductors 241C and 242C and the via conductors 341C, 342C, and 343C compose the fourth inductor L4C illustrated in FIG. 9. The fourth inductor L4C has a central axis passing through the center positions of the winding forms of the coil conductors 241C and 242C along the laminated direction of the magnetic multilayer body 100C. When the magnetic multilayer body 100C is viewed in plan, the fourth inductor L4C has a shape that extends in a direction in which the angle is varied in the plus (+) direction from the external connection terminal 440C, that is, that extends counterclockwise in an X-Y coordinate system using the center of the winding forms of the coil conductors 241C and 242C as the origin.

In addition, the via conductor 300C couples an intersection E00 of the common conductor 510C to the common external connection terminal 400C. As a result, the first, second, third, and fourth inductors L1C, L2C, L3C, and L4C are coupled to the common external connection terminal 400C.

In the above structure, the coil conductor 211C composing the first inductor L1C is adjacent to the coil conductor 221C composing the second inductor L2C in the laminated direction with the magnetic layer 180C sandwiched therebetween. The coil conductor 221C composing the second inductor L2C is adjacent to the coil conductor 231C composing the third inductor L3C in the laminated direction with the magnetic layer 170C sandwiched therebetween. The coil conductor 231C composing the third inductor L3C is adjacent to the coil conductor 241C composing the fourth inductor L4C in the laminated direction with the magnetic layer 160C sandwiched therebetween. The coil conductor 241C composing the fourth inductor L4C is adjacent to the coil conductor 212C composing the first inductor L1C in the laminated direction with the magnetic layer 150C sandwiched therebetween.

The coil conductor 212C composing the first inductor L1C is adjacent to the coil conductor 222C composing the second inductor L2C in the laminated direction with the magnetic layer 140C sandwiched therebetween. The coil conductor 222C composing the second inductor L2C is adjacent to the coil conductor 232C composing the third inductor L3C in the laminated direction with the magnetic layer 130C sandwiched therebetween. The coil conductor 232C composing the third inductor L3C is adjacent to the coil conductor 242C composing the fourth inductor L4C in the laminated direction with the magnetic layer 120C sandwiched therebetween.

In other words, the coil conductors composing the first inductor L1C, the coil conductors composing the second inductor L2C, the coil conductors composing the third inductor L3C, and the coil conductors composing the fourth inductor L4C are periodically arranged along the laminated direction.

With the above structure, the coil conductors composing the first inductor L1C are magnetically coupled to the coil conductors composing the second inductor L2C, the coil conductors composing the second inductor L2C are magnetically coupled to the coil conductors composing the third inductor L3C, the coil conductors composing the third inductor L3C are magnetically coupled to the coil conductors composing the fourth inductor L4C, and the coil conductors composing the fourth inductor L4C are magnetically coupled to the coil conductors composing the first inductor L1C. Accordingly, it is possible to achieve a high degree of coupling between the inductors that are adjacent to each other in the laminated direction.

In addition, since the winding forms of the first, second, third, and fourth inductors L1C, L2C, L3C, and L4C are substantially overlapped with each other when the magnetic multilayer body 100C is viewed in plan and the central axes of the first, second, third, and fourth inductors L1C, L2C, L3C, and L4C substantially coincide with each other, it is possible to achieve a higher degree of coupling between the first, second, third, and fourth inductors L1C, L2C, L3C, and L4C.

Furthermore, in the above structure, when the magnetic multilayer body 100C is viewed in plan, the winding direction of the first inductor L1C from the external connection terminal 410C to the common external connection terminal 400C is opposite to the winding direction of the second inductor L2C from the external connection terminal 420C to the common external connection terminal 400C.

The winding direction of the second inductor L2C from the external connection terminal 420C to the common external connection terminal 400C is opposite to the winding direction of the third inductor L3C from the external connection terminal 430C to the common external connection terminal 400C.

The winding direction of the third inductor L3C from the external connection terminal 430C to the common external connection terminal 400C is opposite to the winding direction of the fourth inductor L4C from the external connection terminal 440C to the common external connection terminal 400C.

The winding direction of the fourth inductor L4C from the external connection terminal 440C to the common external connection terminal 400C is opposite to the winding direction of the first inductor L1C from the external connection terminal 410C to the common external connection terminal 400C.

Accordingly, when current is caused to flow from the external connection terminals 410C, 420C, 430C, and 440C in the same direction or current is caused to flow from the common external connection terminal 400C, the direction of the magnetic fluxes occurring in the adjacent inductors in the first, second, third, and fourth inductors L1C, L2C, L3C, and L4C are opposite to each other. As a result, since destructive interference occurs between the magnetic flux occurring in the adjacent inductors, saturation of the magnetic flux caused by an increase in the current value is difficult to occur. In other words, it is possible to increase saturation current of the first, second, third, and fourth inductors L1C, L2C, L3C, and L4C. Accordingly, the above structure is effective when multiple choke coils are coupled to each other for use (when the choke coils are used for the multiphase DC-DC converter).

Furthermore, since the first, second, third, and fourth inductors L1C, L2C, L3C, and L4C are coupled to each other in the structure of the present embodiment, it is not necessary to couple the first, second, third, and fourth inductors L1C, L2C, L3C, and L4C to each other with an external circuit.

Furthermore, since the via conductor 300C coupled to the common external connection terminal 400C exists at a position substantially coinciding with the central axis of the winding forms of the first, second, third, and fourth inductors L1C, L2C, L3C, and L4C in the structure of the present embodiment, it is possible to suppress interference between the magnetic fluxes caused by the first, second, third, and fourth inductors L1C, L2C, L3C, and L4C and the via conductor 300C.

REFERENCE SIGNS LIST

1 DC-DC converter

10, 10A, 10B, 10C multilayer inductor device

100, 100A, 100B, 100C magnetic multilayer body

110, 120, 130, 140, 110A, 120A, 130A, 140A, 150A, 160A, 110B, 120B, 130B, 140B, 150B, 160B, 170B, 180B, 110C, 120C, 130C, 140C, 150C, 160C, 170C, 180C 190C magnetic layer

101, 102 non-magnetic layer

211, 212, 221, 222, 211A, 212A, 221A, 222A, 211B, 212B, 221B, 222B, 231B, 232B, 241B, 242B, 211C, 212C, 221C, 222C, 231C, 232C, 241C, 242C coil conductor

311, 312, 313, 321, 322, 323, 300A, 311A, 312A, 313A, 321A, 322A, 323A, 311B, 312B, 313B, 321B, 322B, 323B, 331B, 332B, 333B, 341B, 342B, 343B, 300C, 311C, 312C, 313C, 321C, 322C, 323C, 331C, 332C, 333C, 341C, 342C, 343C via conductor
400, 400C common external connection terminal
410, 420, 410C, 420C, 430C, 440C, 411, 412, 421, 422 431, 432, 441, 442 external connection terminal
511, 521 common conductor 511
901 DC power supply
911, 912, 913, 914 switch element
921, 922 driver circuit
903 load
904 controller
C0 output capacitor
L1, L1A, L1B, L1C, L2, L2A, L2B, L2C, L3B, L3C, L4B, L4C inductor
Po1 high-voltage-side output terminal
Po2 low-voltage-side output terminal

The invention claimed is:

1. A multilayer inductor device comprising:

a magnetic multilayer body in which a plurality of magnetic layers are laminated; and a plurality of inductors each comprising at least two coil conductors provided on certain different layers in the plurality of magnetic layers and a via conductor that passes along a laminated direction through the coil conductors provided on the different layers, and a common conductor electrically connects first end portions of the plurality of inductors to each other at a first side of the magnetic multilayer body along the laminated direction, wherein the coil conductors each have a winding form, wherein central axes of the winding form along the laminated direction of the coil conductors of the plurality of inductors substantially coincide with each other, wherein the respective coil conductors composing the plurality of inductors are alternately and periodically arranged along the laminated direction, wherein the coil conductors composing each of the plurality of inductors are alternately arranged so as to sandwich the coil conductors composing a different inductor there between, wherein the multilayer inductor device includes an external connection terminal coupled to at least two individual second end portions of the plurality of inductors, the second end portions being on a second side of the multilayer inductor device opposite to the first side of the magnetic multilayer body where the first end portions of the plurality of inductors are coupled to the common conductor and a common external connection terminal coupled to the common conductor, the external connection terminals and the common external connection terminal being provided on a layer opposite to the first side along the laminated direction of the magnetic multilayer body, and wherein the common conductor and the common external connection terminal are directly connected to each other by a via conductor provided at positions substantially coinciding with the central axes of the winding form.

2. The multilayer inductor device according to claim 1, wherein the plurality of inductors are coupled to each other so that, when current flows, directions of magnetic fluxes occurring in the inductors are opposite to each other between the inductors, the coil conductors between the inductors being adjacent to each other in the laminated direction.

* * * * *